United States Patent [19]

Lizotte

[11] 4,123,878

[45] Nov. 7, 1978

[54] GRINDING MACHINE

[75] Inventor: Robert H. Lizotte, Leominster, Mass.

[73] Assignee: Cincinnati Milacron-Heald Corp., Worcester, Mass.

[21] Appl. No.: 815,704

[22] Filed: Jul. 14, 1977

Related U.S. Application Data

[63] Continuation of Ser. No. 638,936, Dec. 8, 1975, abandoned.

[51] Int. Cl.[2] ..... B24B 49/18

[52] U.S. Cl. ..... 51/165.87

[58] Field of Search ..... 51/165 R, 165.8, 165.87, 51/165.91, 165.92, 165.9

[56] References Cited

U.S. PATENT DOCUMENTS

| | | | |
|---|---|---|---|
| 3,535,828 | 10/1970 | Ware | 51/165.8 |
| 3,601,929 | 8/1971 | Uhtenwoldt | 51/165.9 |
| 3,601,930 | 8/1971 | Robillard | 51/165.8 |
| 3,703,054 | 11/1972 | Uhtenwoldt | 51/165.91 |
| 3,736,704 | 6/1973 | Robillard et al. | 51/165.78 |
| 3,913,277 | 10/1975 | Hahn | 51/165.92 |

*Primary Examiner*—Harold D. Whitehead

*Attorney, Agent, or Firm*—Norman S. Blodgett; Gerry A. Blodgett

[57] ABSTRACT

A grinding machine in which sparkout grinding is carried out for a period of time that is selected from workpiece to workpiece by a power meter means which terminates grinding when the power consumed by the wheel reaches a predetermined value, which value is varied from new wheel conditions to worn wheel conditions.

6 Claims, 6 Drawing Figures

GRINDING MACHINE

This is a continuation of application Ser. No. 638,936 filed Dec. 8, 1975, now abandoned.

BACKGROUND OF THE INVENTION

There are many situations encountered in the abrasive machining of workpieces in which the quality of the finished surface may vary due to variations in the grindability of the unfinished surfaces from one workpiece to another. An outstanding example of a situation in which this problem is encountered is in the grinding of the internal bore of a hydraulic valve lifter for use in an internal combustion engine. To perform this grinding operation, it is necessary to use a long wheel, which means that a considerable amount of spindle deflection takes place. It would be possible by well-known means to compensate for this deflection to prevent the bore from being ground with an undesired taper, if the grindability of the bores were the same in all workpieces. However, in the case of the hydraulic valve lifter, the workpiece must be heat-treated prior to the grinding operation. The heat treatment (or, in some cases, the basic material or previous operations) causes the grindability to vary from workpiece to workpiece. These differences in grindability from one workpiece to the next cause the spindle and the abrasive wheel to deflect by different amounts and to produce different amounts of taper in the internal bore of the valve lifter. Now, it so happens that taper in the internal bore of a hydraulic valve lifter is particularly undesirable, because, if the taper exceeds a small tolerance, noisy operation of the engine results.

It is the usual practice in grinding to provide a "sparkout" period at the end of a grinding cycle. This is accomplished by terminating cross-feed allowing the grinding to continue under the impetus of the deflection of the spindle, which deflection can be appreciable, particularly in an internal grinding machine. Such a sparkout period relieves the workpiece surface of any taper that may be present due to spindle bending and also provides for a better surface finish because of the light final pressure between the wheel and the workpiece.

As the demands on grinding machines increase for smaller tolerance on taper, size, and finish, the conventional sparkout leaves something to be desired. First of all, final gage size usually terminates the sparkout. The amount of taper in the workpiece bore (for internal grinding) depends on the amount of deflection left in the spindle at the final size point, and this depends, in turn, on the amount of deflection at the beginning of sparkout. As has been stated, this starting deflection varies from workpiece to workpiece, so that the final taper tends to vary also. If one attempts to overcome this deficiency by allowing the wheel to grind until deflection is entirely removed from the spindle, the grinding cycle becomes very long, and this is unacceptable in the case of an expensive automatic grinding machine, because it increases the amount of labor cost, overhead, and capitalization applicable to each workpiece.

It has been found, furthermore, that the best surface finish is obtained when the finish grinding takes place with an appreciable force between the wheel and workpiece, rather than allowing the force to fall off a very small value, as is sometimes true in the conventional sparkout. Such an appreciable force is, however, substantially less than the amount used in "controlled force" grinding where the force used is as high as is feasible without destruction of the wheel. Nevertheless, many attempts have been made in the past to provide a relatively low, but, nevertheless, appreciable value of force during the finish period of the grinding cycle. Since the controlled force used in the roughing portions of the cycle are produced by using a hydraulic cylinder and by controlling the oil pressure and drain restriction for the cylinder, it was natural to try to maintain this low-value force by this means. However, it proved to be unfeasible to hold the forces constant within the required limits, because of the conduits, grinding swarf, guards, etc. It was also suggested that the low-value force could be obtained by swivelling the wheelhead, but experiment proved that the amount of swivel necessary to take care of the deflection difference between finishing with a large wheel and finishing with a small wheel is infinitesimally small, i.e., in the order of magnitude of the deflection resulting from a force change of one pound. Maintaining forces within such low values has proved to be impossible, especially under shop conditions. One method that has been suggested to overcome these problems is shown and described in the patent of Ware et al U.S. Pat. No. 3,535,828 which issued Oct. 27, 1970. In that case sparkout takes place as usual without any crossfeed. A control, including a device for measuring the load on the wheelhead motor, is connected to the feed mechanism to bring about a dressing of the wheel if the rate of grinding takes place at too slow a speed. The speed of spark removal during sparkout is measured by starting a timer at the same time that sparkout starts and if the power meter does not show that the power to the wheel has dropped to a predetermined level before the timer times out, then this is an indication that the wheel is dull and the machine is operated to dress the wheel. The wheel is then returned to finish the sparkout. An extension of that particular method is shown and described in the patent of Uhtenwoldt U.S. Pat. No. 3,703,054 which issued Nov. 21, 1972. In this last patent, a small increment of load is introduced into the machine every time the meter shows that the power has dropped to a predetermined level. In this way the grinding wheel approaches the final size, while still maintaining appreciable force between the wheel and the workpiece. In this way the size and taper reach the desired amounts without the grinding operation following into the extremely low load situation that is described above as being undesirable.

While these devices operate in a desirable manner, nevertheless, they sometimes result in an extremely long grinding cycle which is, of course, undesirable from a business point of view because of the high capital expense of the grinding machine. These and other difficulties experienced with the prior art devices have been obviated in a novel manner by the present invention.

It is, therefore, an outstanding object of the invention to provide a grinding machine which will permit one to maintain the quality of finished surface within a narrow range of tolerance despite variations in wheel size.

Another object of this invention is the provision of a grinding machine for grinding deep bores in workpieces while maintaining taper within a narrow range of tolerance despite substantial variation in hardness of the unfinished bore surface as well as the diameter of the abrasive wheel.

It is another object of the instant invention to provide a grinding machine having an operating cycle which reduces the variation of taper in finished surfaces of revolution to within a narrow range of tolerance despite substantial variations in unfinished workpiece surface quality from workpiece to workpiece.

It is a further object of the invention to provide a grinding machine for grinding bores without wide variation in taper in workpieces where the wheel length is large as compared to the diameter.

A still further object of this invention is the provision of a grinding machine which will operate in such a manner that, when a given workpiece arrives in the machine and has a surface grindability outside of a narrow range of tolerance, the abrasive wheel surface will not be affected in such a way as to produce poor surface quality in subsequently ground workpiece surfaces.

It is a still further object of the present invention to provide a grinding machine which operates in such a way that when excessive loads are encountered (which would break down the wheel surface due to a variation in grindability of a particular workpiece), the apparatus automatically compensates for breakdown in abrasive wheel surface, so that not only is the quality of subsequent workpieces provided for, but the particular workpiece itself is finished with a quality within tolerance.

Another object of the invention is the provision of a grinding machine which grinds at a high force during a roughing grind followed by operation at a low force finish grind and in which the point at which the shift from rough to finish grind takes place is adjusted to compensate for the change in size of the wheel from new to worn conditions.

Another object of the invention is the provision of a grinding machine in which the breakdown of abrasive wheel surface due to the unusual character of the particular workpiece will be compensated for during the grinding cycle involving that particular workpiece, because the breakdown is sensed early enough in the cycle for compensation to be made to the abrasive wheel so that the cycle can finish in the normal way.

Another object of the invention is the provision of a grinding machine having a grinding cycle with a first rough grind and a subsequent finish grind in which a breakdown of the abrasive wheel due to difficult grindability of a particular workpiece is compensated for by dressing after the rough grind so that the finish grind takes place in a normal manner.

It is, therefore, an outstanding object of the invention to provide a grinding machine in which sparkout is feasible even under close tolerances of size, taper, and surface finish.

A further object of the present invention is the provision of a grinding machine in which the taper in successive workpieces is maintained at a preselected value.

It is another object of the instant invention to provide a grinding machine in which good repeatability of taper and size is obtainable.

It is a further object of the invention to provide a grinding machine wherein short grinding cycles are possible without exceeding selected tolerances on taper and finish.

It is a still further object of the present invention to provide a grinding machine in which surface finish does not change due to the reduction in diameter of the abrasive wheel as it wears and is dressed from the large new wheel to the small worn wheel.

With these and other objects in view, as will be apparent to those skilled in the art, the invention resides in the combination of parts set forth in the specification and covered by the claims appended hereto.

SUMMARY OF THE INVENTION

In general, the invention consists of a grinding machine for internal grinding, the machine having a base on which are mounted a wheelhead for carrying a rotatable abrasive wheel and a workhead for carrying a workpiece having a bore to be finished. A meter means is connected to the wheelhead to give a power signal indicative of the power consumed by the wheelhead and to terminate a grinding cycle when the signal reaches a predetermined value. A wheelsize monitor is provided for measuring the wheel and giving a size signal indicative of the size of the wheel. A zero shift control means receives the signal from the wheelsize monitor and adjusts the said predetermined value of the power meter in accordance with a predetermined pattern during the life of a wheel as it wears from its "new wheel" condition to its "worn wheel" condition.

More specifically, the predetermined pattern is a straight line from a high value at the new wheel condition to a low value at the worn wheel condition. The meter contains a switch and a bridge circuit, the bridge circuit having a first branch giving a reference signal and a second branch on which is impressed the said power signal. The switch is actuated to terminate the grinding cycle when the reference signal and the power signal are equal, the said size signal being used to adjust the said reference signal with changes in wheel size. Furthermore, means is provided to terminate the finish grind at a given point in the wheelhead crossfeed, the length of the sparkout grind being determined solely by the power meter and its switch.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
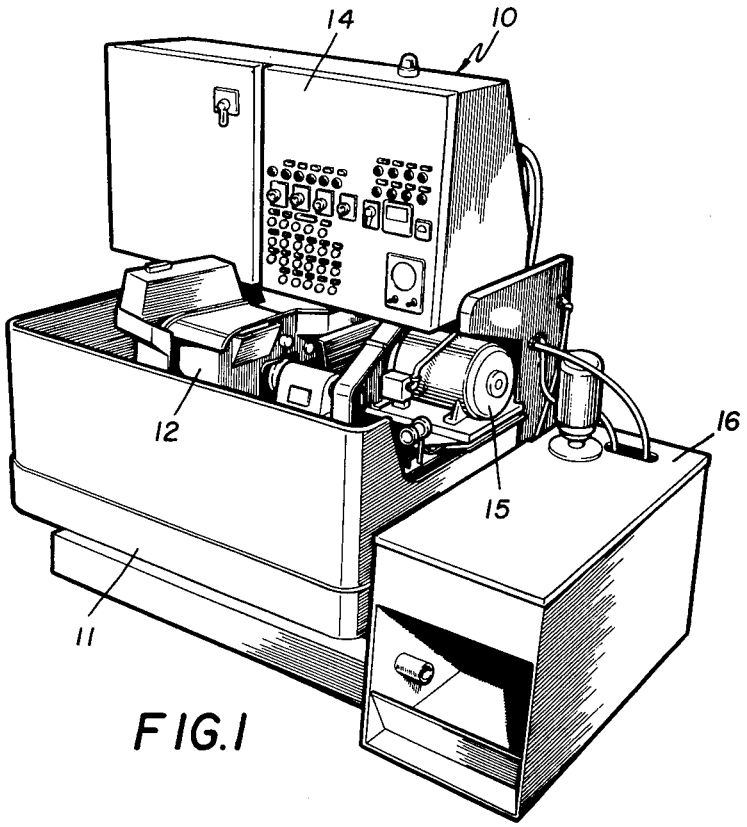
FIG. 1 is a perspective view of a grinding machine embodying the principles of the present invention.

Referring first to FIG. 1, wherein are best shown the general features of the invention, the grinding machine, indicated generally by the reference numeral 10, is shown as consisting of a base 11 on which is mounted a workhead 12 for carrying a workpiece having a bore to be finished and a wheelhead 13 for carrying a rotatable abrasive wheel. Also mounted on the base 11 is a control cabinet 14. The wheelhead 13 is driven by a motor 15. Mounted beside the machine is a source 16 of pressure oil for lubrication and operation of the machine.

Figure 2:
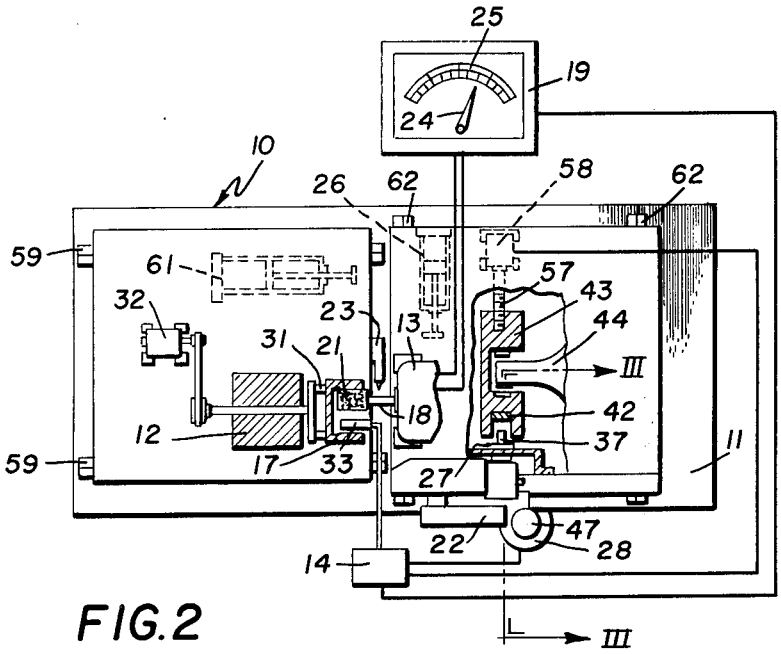
FIG. 2 is a plan view somewhat schematic of the operating elements of the machine.

Referring to FIG. 2, it can be seen that the workhead 12 is mounted on a table and carries a workpiece 17 which is shown as a hydraulic valve lifter whose bore is to be finished. The wheelhead 13 is also mounted on a table and carries a rotatable spindle 18, on the outer end of which is mounted an abrasive wheel 21. At the front of the table carrying the wheelhead 13 is mounted a feed box 22. Mounted on the table carrying the workhead 12 is a diamond dressing unit 23 which is of the type which is hinged to move up into an inoperative position and down to an operative position. Also mounted on the same table is a loading mechanism (not shown).

The grinding machine 10 is provided with a crossfeed hydraulic cylinder 26, as well as a retractable stop mechanism 27 operated by a stepping motor 28. The grinding machine is also provided with various other controls as will be described more fully hereinafter. The workhead 12 has support shoes (not shown) which engage and support the outer surface of the workpiece 17. One end of the workpiece is engaged and driven by a drive platen 31 which is suitably rotated by a motor 32. Located internally of the workpiece bore is a gage 33 which takes a continuous reading (during certain portions of the grinding cycle) of the size of the bore in the workpiece that is being ground. The other end of the workpiece is engaged by a clamping means (not shown) in the usual way.

It can be seen that a compensation slide 43 is engaged at the rear by a ball screw 57 operated by a stepping motor 58. The workhead table is mounted on ways 59 for movement longitudinally of the axis of the workpiece and this motion is brought about by the operation of a hydraulic cylinder 61. By means of the usual controls, the table can be reciprocated during grinding in the usual way. The wheelhead table is mounted on ways 62 for transverse motion. The gage 33 is shown as being of the pneumatic type having a lead extending outwardly to the control cabinet 14. The motor 15 driving the wheelhead is provided with a load meter means such as a load meter 19, an indicating hand 24, and a scale 25.

Figure 3:
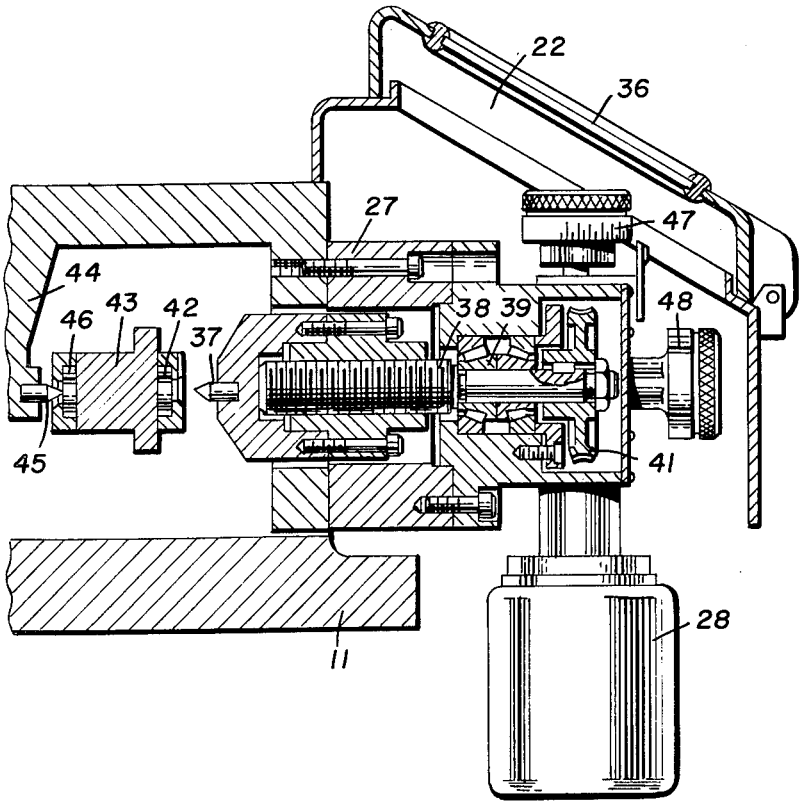
FIG. 3 is a sectional view of a portion of the machine taken on the line III—III of FIG. 2.

FIG. 3 shows the interior of the retractable stop mechanism 27 and it also shows the manner in which the feed box 22 is provided with an observation window 36. The stop mechanism 27 is bolted to the front of the table which carries the wheelhead 13 which, in turn, is mounted for transverse sliding motion over the base 11. A contact element 37 is slideably mounted in the housing of the stop and is propelled transversely by rotation of a ball screw 38. The ball screw is, in turn, mounted in bearings 39 and is driven by a worm gear 41. Contact element 37 is positioned to engage on occasion with a hardened element 42 mounted on a forwardly-facing surface of the secondary or compensating slide 43. A horn 44 extends downwardly from the wheelhead table and is provided with a contact element 45 adapted on occasion to engage a hardened metal element 46 mounted on a rearwardly-directed surface of the compensating slide 43. The worm gear 41 and, therefore, the ball screw 38, is driven by the stepping motor 28 and is manually adjustable by means of a knob 47. A manual compensating knob 48 extends from the front of the machine.

Figure 4:
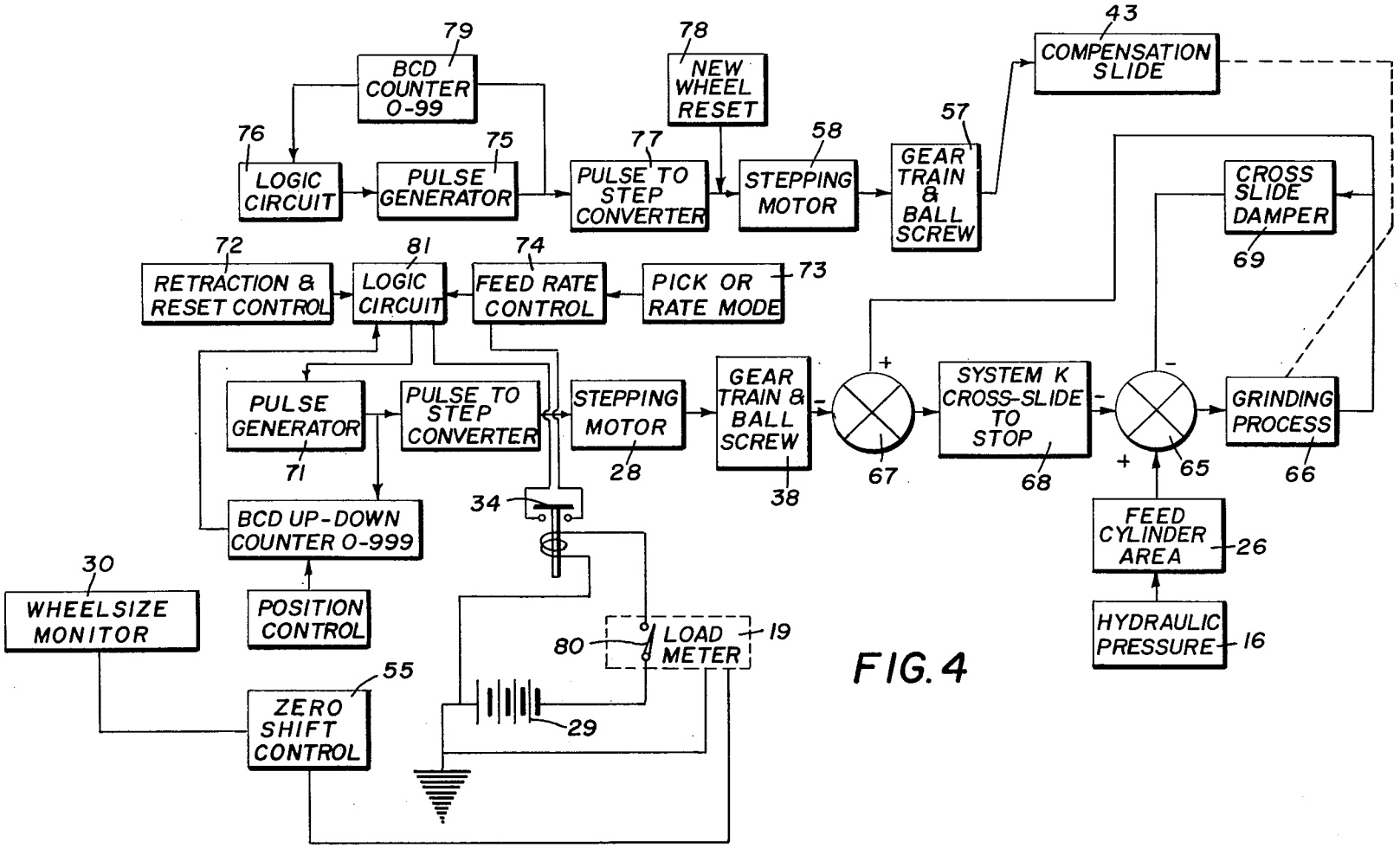
FIG. 4 is a schematic view of the electrical and hydraulic controls used in the machine.

FIG. 4 is helpful in understanding the operation of the invention. Hydraulic pressure originating in the source 16 is passed on to the feed cylinder 26 which operates through a mixer 65 to produce a grinding process 66. These forces make themselves felt at a mixer 67 which operates through the spring constant K of the system (indicated by the box 68) which, in turn, feeds a force signal into the mixer 65. The grinding process also is effected by a cross-slide damper 69 receiving force in the grinding process 66 and entering into the mixer 65. At the same time a pulse generator 71 operates the stepping motor 28 and this is effective through the gear train and ball screw 38 to operate through the mixer 67 on the system spring constant box 68. Retraction and reset control 72 controls the flow of pulses from the pulse generator 71 to the stepping motor 28. Similarly, a pick- or rate-mode selection 73 operates through a feed-rate control 74 to also regulate the flow of pulses from the generator 71 to the stepping motor 28. The grinding process 66 is effected by the compensation slide 43 which, in turn, is regulated by the stepping motor 58 operating through a gear train and ball screw 57. A pulse generator 75 is controlled by a logic circuit 76 which, in turn, operates through a pulse-to-step converter 77 in the stepping motor control. The variation in operation being possible by means of the "new wheel" reset control 78. Feedback takes place between the output of the pulse generator 75 and the input of the logic circuit 76 through a binary code decimal counter 79 (bcd counter). A switch 80 in the load meter 19 is connected through an electrical source 29 to ground. The contact side of the switch is connected to a relay whose contacts 34 are normally open and connected between the feed rate control 74 and the logic circuit 81. The contacts 34 act as a gate to the flow of stepping motor pulses and acts on occasion to terminate the grinding cycle.

A wheelsize monitor 30 is connected to a zero shift control 55 which, in turn, is connected to the load meter 19, as will be more fully described hereinafter.

Figure 5:
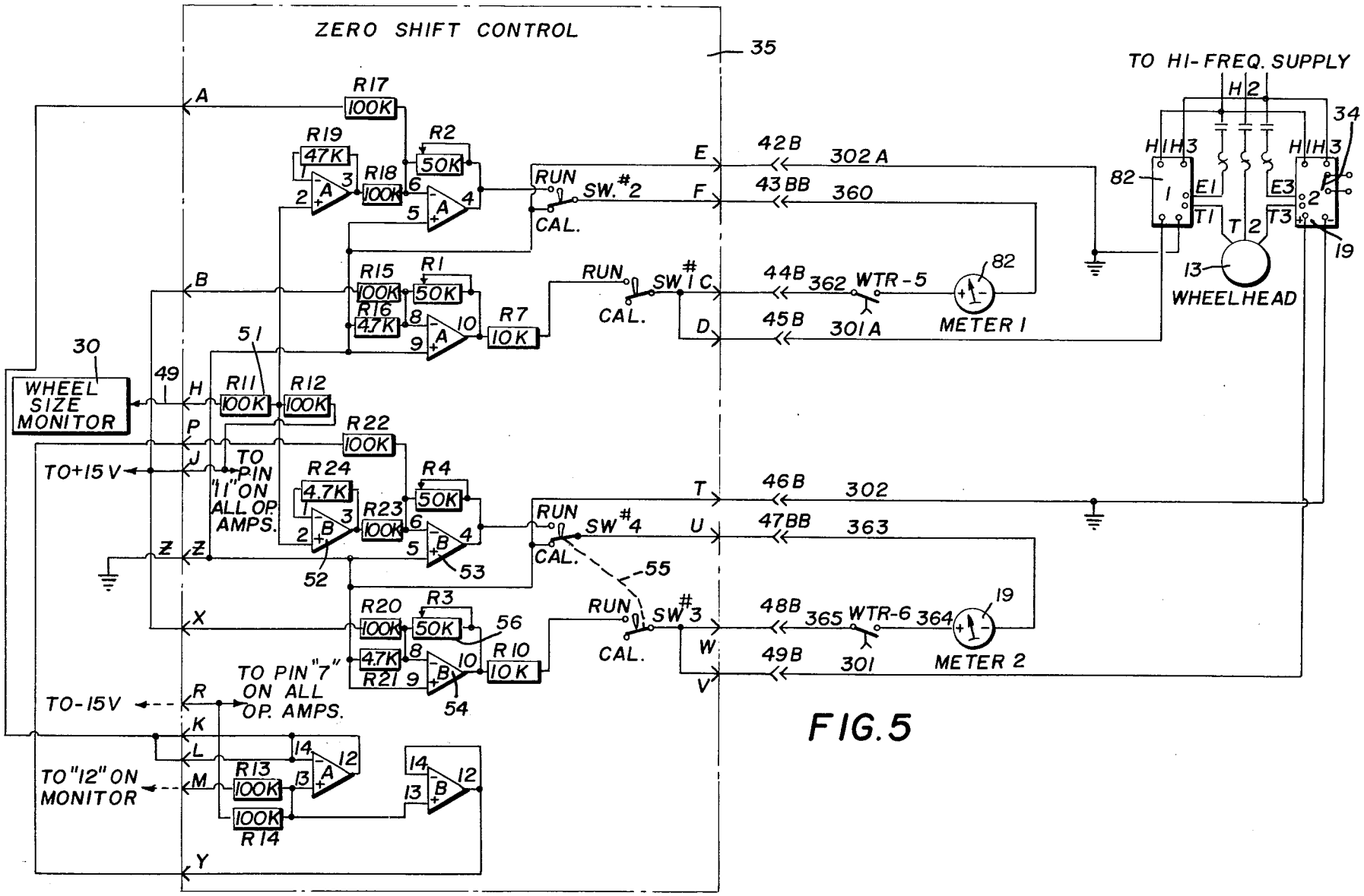
FIG. 5 is an electrical diagram showing a zero shift control forming part of the machine.

FIG. 5 shows the details of the zero shift control means and its connection to the wheelsize monitor 30 and the load meter 19. The wheelsize monitor 30 is of the type shown and described in the patent of Robillard U.S. Pat. No. 3,601,930 which issued on Aug. 31, 1971; that patent describes a digital counter which keeps track of the number of pulses introduced for compensation after dress, so that the size of the wheel is continuously counted by the process of subtracting compensation pulses from the original total wheel size which was determined at the time of the new wheel dress. In other words, as the wheel becomes dressed to smaller and smaller sizes, record of the size of the remainder of the wheel is available. In FIG. 5 this signal of the remaining size of the wheel is connected by a line 49 through a resistor to the input side of an operational amplifier 52. The output side of the amplifier 52 is connected to the input side of operational amplifiers 53 and 54 whose outputs, in turn, pass through a double switch 55 leading to the meter 19. The meter 19 has a first branch, lines 363, 364, and 365, which not only receives the reference signal from the operational amplifier 54, but also a signal from the operational amplifier 53 and compares it with the signal on another branch, lines 301 and 302, containing a signal proportional to the load on the wheelhead 13. When the signals on the two branches are equal, the contacts 34 open and terminate the grinding cycle. It should be noted that another load meter 82 is similarly connected to the wheelsize monitor 30 and to the wheelhead 13 and is provided with its own operational amplifiers in the zero shift control 35. This second meter can be used in grinding cycles in which a spark-out is used following the rough grind.

Figure 6:
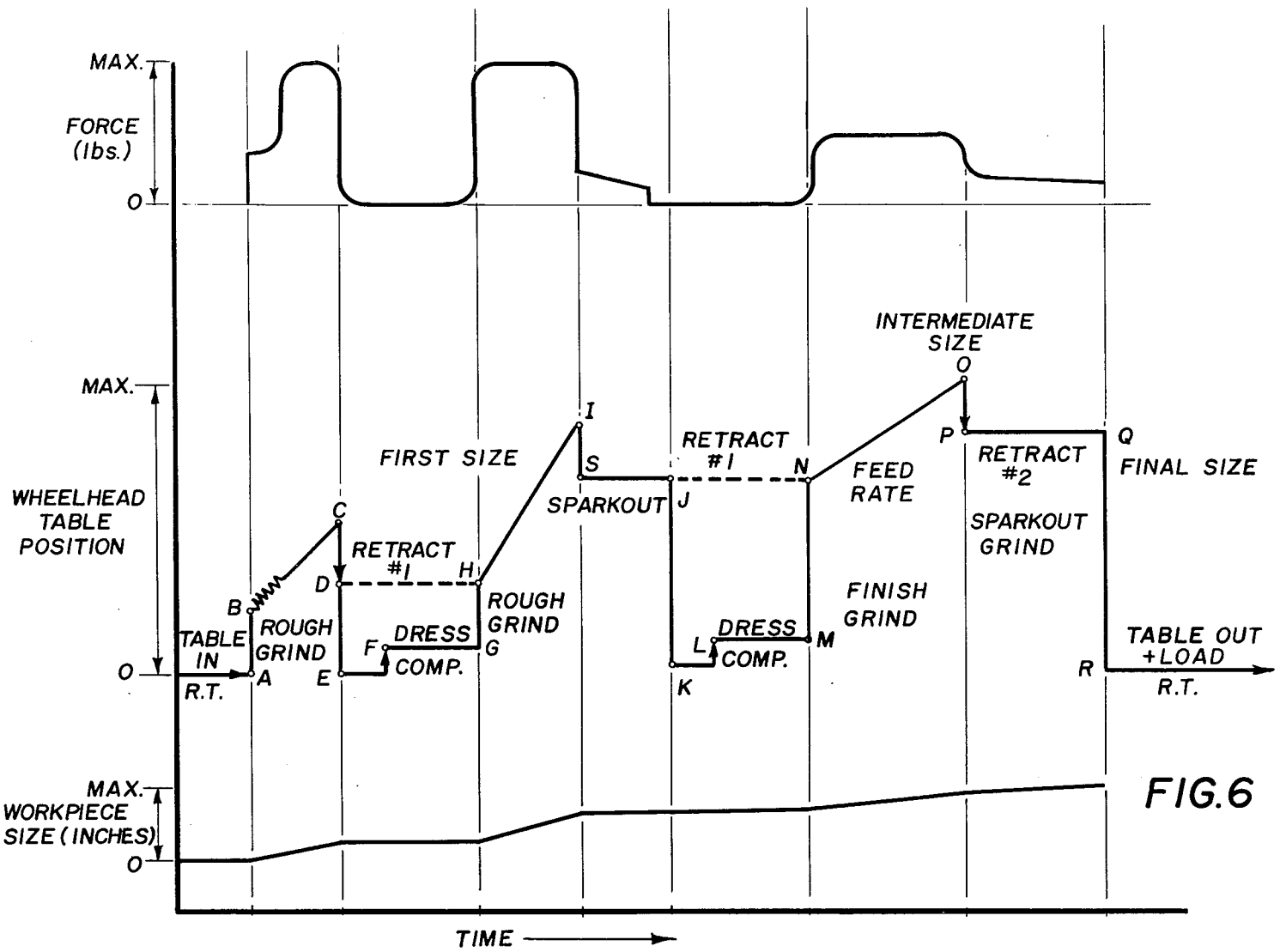
FIG. 6 is a graphical representation of the operation of the machine.

The general operation of the grinding machine can be best understood by reference to FIG. 6. The cycle shown and described in that drawing is a typical cycle which might be used to grind a long bore in a particularly difficult workpiece having a very hard surface to be ground. Referring first to the wheelhead table position graph in the center, it can be seen that the table for the workhead 12 moves inwardly on rapid traverse to the point A, so that the abrasive wheel 21 lies within the workpiece 17. The hydraulic crossfeed cylinder 26 is energized to cause the wheelhead table to move transversely and to bring the wheel into engagement with the surface to be finished. Engagement of the abrasive wheel 21 with the surface of the workpiece 17 takes place at the point B and the workhead table begins reciprocation under the impetus of the cylinder 61. In the meanwhile, the wheel is advanced laterally into the workpiece under the hydraulic pressure in the cylinder 26 on a controlled-force grinding operation. This operation is a rough grind that consists in rounding up the bore in the workpiece and removing substantial amounts of material from the surface. Eventually a point C is reached, as determined by a timer which had started at the point A. A retraction of the wheelhead table rearwardly to the point D takes place to relieve the deflection in the spindle 18 and a further action by means of the cylinder 26 carries the wheelhead forwardly to the point E where the horn 44 engages the rearwardly facing surface of the compensation slide 43. The compensation slide is then moved rearwardly by introducing a suitable number of pulses into the stepping motor 58. This also has the effect of carrying the wheelhead table rearwardly a short compensating distance. The workhead table is then operated by the cylinder 61 to cause the diamond dressing unit 23 to move past the wheel 21 to dress the wheel; at that time the point G is reached. The wheelhead 13 is then moved rearwardly by the cylinder 26 so that the wheel engages the workpiece at the point H which, because of the retraction from point C to point D that previously took place, means that the wheel begins grinding without "cutting air". Another rough grind takes place to the point I, where a short retraction to the point S takes place and then the wheelhead table is locked in place to allow a sparkout to the point J. The retraction and dress cycle similar to the one described before takes place with a retraction from J to K and a dress compensation movement to the point L. After another dress has been completed at the point M, the wheelhead table is moved inwardly again engaging the workpiece at the point N and feed rate grinding takes place from the point N to the point O by operation of the stepping motor 28, the pressure oil in the cylinder 26 causing the wheelhead table to be pushed forwardly against the stop element 37 and the retraction of that stop element by the motor 28 causing the wheel to advance at a selected feed rate. The feed rate grinding takes place to the point O which is determined, in the preferred embodiment, by the gage 33 as being the intermediate size; it will be understood that this could be accomplished the same way by the table engaging a suitable switch in accordance with the "Sizematic" principle, as is well known. At the point O a signal takes place stopping the grinding operation and introducing a small retraction movement bringing the table to the point P. This retraction is considerably less than from the point C to the point D or from the point I from the point S, because the low-force cutting during this "finish" portion of the cycle has caused a smaller deflection of the spindle 18. After the retraction takes place, the wheel is allowed to "sparkout" and to grind the workpiece to the point Q which is the final size point. The wheelhead table is then backed off to the point R where the workhead table is moved out on rapid traverse, the workpiece is removed, and a new workpiece is inserted during the loading portion of the cycle.

During the sparkout grind, as soon as the abrasive wheel removes enough material from the workpiece to lower the load enough so that the two branch signals in the meter 19 are equal, the grinding cycle is terminated at the point Q. The closing of the internal switch 80 in the load meter 19 causes the opening of the contacts 34 which operate to terminate the grinding cycle on that particular workpiece. As the wheelsize progresses from its new wheel condition to its worn wheel condition, the wheelsize monitor will cause the size of the signal on the reference branch of the meter to be changed, so that the load signal which appears in the load branch of the meter becomes lower and lower in accordance with a straight-line pattern. In other words, the size of the load at which the cycle is terminated has a straight line relationship to the reduction in size of the wheel.

At the top part of the chart shown in FIG. 6, the forces used during the various parts of the cycle are clearly demonstrated. The force drops off during the sparkout from the point S to the point J (when a rough grind sparkout is used) and it deteriorates in a more or less straight line from the point P to the point Q during the final sparkout grind. What is desired, of course, is that the unit pressure between the wheel and the workpiece be the same at the end of each workpiece whether the workpiece is being ground by a new wheel or by a worn wheel and it is the purpose of the present invention to accomplish this. When this is accomplished, the taper and size of the bores of the successive workpieces will remain more nearly the same in a series of workpieces during the period from new wheel conditions to worn wheel conditions.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A grinding machine for internal grinding, comprising:

(a) a base on which are mounted a wheelhead for carrying a rotatable abrasive wheel and a workhead for carrying a workpiece having a bore to be finished, (b) a power meter means connected to the wheelhead to give a power signal indicative of power consumed by the wheelhead and to terminate a grinding cycle when the signal reaches an adjustable predetermined value, said meter means including control circuitry containing a switch and a bridge circuit, the bridge circuit having a first branch giving a reference signal and a second branch on which is impressed the said power signal, the switch being actuated to terminate the grinding cycle when the reference signal and the power signal are equal, (c) a wheelsize monitor for measuring the wheel and giving a size signal indicative of the size of the wheel, and (d) a zero shift control means receiving the signal from the wheel size monitor and adjusting the said predetermined value of the power meter means during the life of a wheel as it wears from its new wheel condition to its worn wheel condition, said predetermined value going from a high value at the new wheel condition to a low value at the worn wheel condition, said size signal being used to adjust the said reference signal with changes in wheel size.

2. A grinding machine as recited in claim 1, wherein the zero shift control contains operational amplifiers that convert the signal from the wheelsize monitor to a value that can be used to adjust the reference signal in the meter.

3. A grinding machine as recited in claim 2, wherein a feed mechanism is provided for bringing about relative movement between the wheelhead and the workhead to cause movement of the wheel with respect to the workpiece in accordance with a grinding cycle consisting of a rough grind, a dressing operation, a finish grind, and a sparkout grind, and wherein a dressing apparatus is provided to perform the dressing operation.

4. A grinding machine is recited in claim 3, wherein means is provided to terminate the finish grind at a given point in wheelhead cross-feed, the length of the sparkout being determined soley by the power meter and its switch.

5. A grinding machine as recited in claim 4, wherein the feed mechanism includes a hydraulic cyliner for producing controlled force grinding during a part of the grinding cycle.

6. A grinding machine as recited in claim 5, wherein the feed mechanism also includes a stepping motor for providing controlled rate grinding during a part of the grinding cycle.

* * * * *